US005827617A

United States Patent [19]

Krauter

[11] Patent Number: 5,827,617

[45] Date of Patent: Oct. 27, 1998

[54] THERMO-TRANSFER RIBBON

[75] Inventor: Heinrich Krauter, Hombrechtikon, Switzerland

[73] Assignee: Pelikan Produktions AG, Zurich, Switzerland

[21] Appl. No.: 763,829

[22] Filed: Dec. 11, 1996

[30] Foreign Application Priority Data

Dec. 21, 1995 [DE] Germany ..... 195 48 033.3

[51] Int. Cl.[6] ..... B41M 5/26

[52] U.S. Cl. ..... 428/484; 428/195; 428/413; 428/423.1; 428/480; 428/522; 428/913; 428/914

[58] Field of Search ..... 428/195, 484, 428/488.1, 488.4, 522, 212, 480, 913, 914, 413, 423.1

[56] References Cited

U.S. PATENT DOCUMENTS

| | | | |
|---|---|---|---|
| 4,740,496 | 4/1988 | Vanier . | |
| 4,840,837 | 6/1989 | Tanaka et al. . | |
| 5,248,543 | 9/1993 | Yamaguchi et al. | 428/195 |
| 5,250,346 | 10/1993 | Nagai et al. | 428/195 |
| 5,312,692 | 5/1994 | Shiraishi . | |
| 5,612,140 | 3/1997 | Sogabe | 428/195 |

FOREIGN PATENT DOCUMENTS

| | | |
|---|---|---|
| 0 688 676 A1 | 12/1995 | European Pat. Off. . |
| 35 22 801C | 10/1986 | Germany . |
| 02 080282 | 3/1990 | Japan . |

*Primary Examiner*—Pamela R. Schwartz
*Attorney, Agent, or Firm*—Fay, Sharpe, Beall, Fagan, Minnich & McKee

[57] ABSTRACT

The invention relates to a thermo-transfer ribbon with a customary carrier, with a wax-based layer of a thermo-transfer color formed on one side of the carrier and an additional layer located between the carrier and the wax-based layer. This thermo-transfer ribbon distinguishes itself in that the additional layer is a wax-based separation layer A) for the wax-based layer B) of the thermo-transfer color wherein the waxes of the wax-based layer have a melting point of approximately 70° C. to 110° C., and wherein in both layers A) and B) a wax-soluble polymer is finely dispersed. The advantages of this thermo-transfer ribbon include the fact that there is no need for development of a topcoat of a dual-layer thermo-transfer color, and that satisfactory prints are obtained with the thermo-printing process.

20 Claims, No Drawings

THERMO-TRANSFER RIBBON

FIELD OF THE INVENTION

This invention concerns a thermo-transfer ribbon with a customary carrier, a wax-based layer of a thermo-transfer color on one side, and another layer arranged between the wax-based layer and the carrier.

BACKGROUND OF THE INVENTION

Thermo-transfer ribbons have been known for some time. They have a foil-type carrier made, for example, of paper, synthetic material or other similar material, and a thermo-transfer color layer, specifically of a plastic-and/or wax-based color, or carbon black. In thermo-print technology, the thermo-transfer color is softened by means of a thermal printhead and transferred to a recording or printing paper. Thermo-printers or thermo-printheads which can be used for this purpose are known, for example, from German Patent DE-AS20 62 494 and 24 06 612 and also German Patent DE-OS 32 24 445. Specifically, the following procedure may, for example, be followed. A letter, consisting of heated dots, to be printed onto a sheet of paper, is formed on the thermo-printhead. The thermo-printhead presses the thermo-transfer ribbon onto a paper to be printed. The heated letter of the thermo-printhead, with a temperature of approximately 400° C., leads to softening of the thermo-transfer color at the heated location and the transfer thereof onto the sheet of paper in contact therewith. The used portion of the thermo-transfer ribbon is then passed to a spool.

The thermo-transfer ribbon can have several thermo-transfer colors adjacent to each other. Colored printed images can thus be produced with the combination of the basic colors of blue, yellow and red. In contrast to customary color photography, disadvantageous developing and fixation is eliminated. Thermo-printers can be operated at high printing speed and without any annoying side noises. For example, a DIN A-4 sheet can be printed in approximately ten (10) seconds.

So-called series or line printers can be employed for printing. The series printers operate with a relatively small, movable printhead of up to approximately 1 $cm^2$. On it, there are arranged, vertically to the direction of printing one (1) or two (2) dot lines wherein "dot" refers to a "controllable" heating point. The number of dots per dot line is between six (6) and sixty four (64), which corresponds to a resolution of between two (2) to sixteen (16) dots/mm. Higher resolutions, for example twenty four (24) to thirty two (32) dots/mm can be expected in the near future. It is characteristic of the series thermo-printhead that it is moved horizontally to the transport direction of the paper during the printing process. With a line-printhead, in contrast to the series printhead, a stationary head or strip is involved. Inasmuch as the print strip is not movable, it must span across the width of the substrate to be printed. Print strips are offered in lengths of up to two hundred, ninety seven (297) mm. Resolution and dot sizes correspond to those of the series-heads. The series-printers are specifically employed in typewriters, videoprints, in PC applications, including word processors and line printers, specifically in bar code printers, in high-volume computer data output units, in facsimile equipment, in ticket printers, address printers, color copiers, and CAD/CAM systems.

In addition to the above described thermo-transfer ribbons, there are also ribbons where the heated symbol is not printed under the effect of a thermo-printhead, but by means of resistance heating of a specifically designed, foil-like carrier. The resistance heating takes place in that the thermo-transfer color and/or its carrier contain electrically conducting materials. The thermo-transfer color, i.e., the "operating layer" proper during the printing process, also contains the materials already mentioned above. In this instance, one talks about an ETR material, or "Electro Thermal Ribbon". A corresponding thermo-transfer print system is described, for example, in U.S. Pat. No. 4,309,117.

In the above described systems of thermo-transfer ribbons, the sharpness of the print and the optical density of the produced print depends, among other things, upon the adhesion of the thermo-transfer color to the paper. It is proportionate to the adhesive surface and the adhesive force. Rough paper has a small adhesive surface, since only the elevated portions of the paper surface are wetted by the melted thermo-transfer color. In German Patent DE-A 35 07 097, there is formed, on the layer of the thermo-transfer color, a so-called "filling layer" which consists of, in melted state, a low-viscous material, which flows during the printing process into the valleys of the rough paper surface and thus increases the adhesive surface. In this case it is a disadvantage that the molten filling layer, when extremely smooth paper, with a roughness of more than 200 Bekk, is involved, can no longer penetrate the paper, so that a layer remains between the paper surface and the color layer. The layer thus has the effect of a "hold-off" layer, as described in European Patent EP-A-0 042 954. The hold-off layer, however, results in inadequate color fastness of the documents, inasmuch as penetration into the paper of the thermo-transfer color is prevented. A hold-off layer effect is not desired for a color-fast document layer.

To avoid the above addressed drawbacks of the state of the art, and specifically to beneficially facilitate printing on rough as well as smooth paper, European Patent EP-B-0 348 661 proposed to incorporate the "hold-off layer" or the adhesive layer, also designated as the "top coat", a sticky, finely distributed, wax-embedded hydrocarbon resin, with the wax having a melting point of between 60° C. to 95° C. The teaching according to European Patent EP 0 206 036 attempts to avoid the need for such adhesive layer or top coat, in that there is formed a wax layer on the layer of a plastic-based thermo-transfer color, and that the plastic-based thermo-transfer color contains thermoplastic synthetic material with a softening point of 60° C. to 140° C.

Even though the above described state of the art of thermo-transfer ribbons distinguish themselves by means of significant disadvantages, there always is the technical process drawback of forming, for the reasons stated above, another layer on the thermo-transfer color layer proper.

Japanese Patent JP-1-38271 A discloses a thermo-transfer ribbon, whereby a heat resistant carrier is successively coated with a first color layer and a second color layer. The first color layers contains a color material and a wax-compatible thermoplastic resin. The second color layer consists of a continuous phase of wax-compatible thermoplastic resin, in which is dispersed a phase of wax and a wax-compatible thermoplastic resin. A color material is finely dispersed in both phases. Both color layers are transferred during the printing process.

Japanese Patent JP-1-196380 A describes a thermo-transfer ribbon with a carrier, an intermediary layer and a color layer. The intermediary layer consists of polyester resin, polyamide resin and carbon black. The color layer consists of a powder of carbon black particles which are encased by water-soluble resin, and a matrix component, wherein the matrix component consists of coloring matter and wax. The water-soluble resin as the enveloping component of the carbon black particles contained in the color layer is, based on its hydrophilic nature, not wax-soluble.

In some cases there was an additional problem in that the above named thermo-transfer ribbons proved to be unsatisfactory, in view of the requirement for a matte color print on the substrate to be printed.

Thus, one object of the invention is to further refine the initially named thermo-transfer ribbon in such a manner that there is no necessity for the formation of a top coat or a two-layered thermo-transfer color, and that satisfactory, matte prints are obtained during the thermo-printing process.

According to the invention, this task is solved by an additional layer comprising a resin-based separation layer A) for the wax based layer B) of the thermo-transfer color, wherein the waxes of the wax-based layer have a melting point approximately ranging between 70° C. to 1 10° C., and wherein in both layers A) and B) a wax-soluble polymer is finely dispersed.

SUMMARY OF THE INVENTION

The invention comprises a thermo-transfer ribbon comprising carrier material having developed on one side of said carrier, a wax-based layer of a thermo-transfer color and having an additional layer arranged between said carrier and said wax-based layer. The ribbon is characterized in that the additional layer is a resin-based separation layer A) for the wax layer B) of the thermo-transfer color, that the waxes of the wax-based layer have a melting point of approximately 70° C. to 110° C., and that a wax soluble polymer is finely dispersed in both layers, A) and B).

DETAILED DESCRIPTION OF THE INVENTION

According to the invention, the initially named thermo-transfer ribbon is refined in such a manner that there is no necessity for the formation of a top coat or a two-layered thermo-transfer color, and that satisfactory, matte prints are obtained during the thermo-printing process. This task is solved by an additional layer comprising a resin-based separation layer A) for the wax based layer B) of the thermo-transfer color, wherein the waxes of the wax-based layer have a melting point approximately ranging between 70° C. to 110° C., and wherein in both layers A) and B) a wax-soluble polymer is finely dispersed. A "separation layer" or "release layer" in the above technical field means a layer which controls, during the printing process, the release of the thermo-transfer color onto the accepting substrate, but which is not transferred itself onto the substrate. A separation layer does not melt during the printing process, though it may perhaps soften and, in addition, it shows high adhesion to the carrier.

The waxes employed within the scope of the invention in layer B) are in accordance with the customary wax definition, subject to the above limitation of a melting point range of between approximately 70° C. and 110° C. Waxes having a melting point between 75° C. and 95° C. are specifically preferred within the scope of the invention. This involves, in its most comprehensive meaning, a material which is solidly to friably hard, coarse to fine crystalline, transparent to opaque, but which is not glass-like, which melts above approximately 70° C., which is just a little above the melting point of relatively low viscosity and not stringy. Waxes of this type are classified a natural waxes, chemically-modified waxes, and synthetic waxes. Among the natural waxes, the vegetable waxes are particularly preferred, such as carnauba wax, candelilla wax, mineral waxes in the form of higher-melting ceresin and higher melting ozokerite (native paraffin), petrochemical paraffins, such as, for example, petrolatum, paraffin-waxes and microwaxes. Specifically preferred among the modified waxes are montanester waxes, hydrated caster oil and hydrated jojoba oil. Preferred among the synthetic waxes are polyalkylene waxes and polyethyleneglycol waxes, including products manufactured therefrom through oxidation and/or esterification. Amid waxes that can likewise be used, modified microcrystalline waxes being particularly preferred.

The melting point range according to the invention for the employed waxes is critical. If the value of 70° C. is not attained, the mechanical anchoring is inadequate and thus color transfer and color resolution are unsatisfactory. Melting points higher than 110° C. disadvantageously result in increased energy expenditure during the printing process.

Among the waxes which are employed according to the invention, "closely cut" waxes are preferably used, whose melting and solidification points are close together. The difference between melting and solidification point is preferably less than 10° C., preferably less than approximately 7° C., and most specifically preferably less than 5° C. Carnauba wax is a good example of this. The melting point of carnauba wax is at approximately 85° C. and its solidification point is at approximately 78° C. The named waxes result during the printing process in desirable low cohesion of the thermo-transfer color.

Multiple additives can be incorporated into the wax materials of the wax-based thermo-transfer color such as, specifically, tackifying agents in the form of terpenphenol resins (such as, for example, the commercial product Zonataclite 85 by Arizona Chemical) and hydrocarbon resins (such as, for example, the commercial produces KW Resin 61 B1/105 by VFT, Frankfurt).

Tinting can be accomplished by means of any coloring agents. It may involve pigments, such as carbon black, but also solvents and/or binding-medium-soluble coloring agents, such as the commercial product Basoprint, organic coloring pigments and various azo coloring materials (Ceres and Sudan coloring materials). Within the scope of the present invention, carbon black is considered particularly suitable. The thermo-transfer color preferably contains the coloring material, specifically the coloring pigment, in a volume of approximately 10% to 20% by weight.

The thermo-transfer color of the above named layer B) of the thermo-transfer ribbon according to the invention, where necessary, with the additions named above, preferably has a viscosity, determined by the rotation viscometer Rheomat 30 with Rheograph (Principle: Rotation-Viscometer, see Bulletin T 304d-7605 of Contraves AG, Zurich, Switzerland) at a temperature of 100° C., of approximately 50 mPa.s to 200 mPa.s, specifically of 70 mPa.s to 120 mPa.s. Falling short of the value of approximately 50 mPA.s results in fuzziness ("spreading"). By exceeding the value of 250 mPa.s, the desired resolution can be deteriorated.

A central characteristic of the thermo-transfer ribbon according to the invention is that a wax-soluble polymer is contained in the two mentioned layers, A) and B). It is understood by "wax-soluble" in this case, that this polymer shows solubility in liquid wax. These do not necessarily involve "genuine solutions", but mostly stable dispersions. As a consequence, during cooling of such a solution of the polymer in wax, phase separation does not occur. In other words, the polymer is compatible with the wax. The melting index MFI lies at 25 g/10 min to 1000 g/10 min, preferably at 400 g/10 min to 800 g/10 min (DIN 53735/ISO 1133—see also Römpp Chemical Lexicon, V. 5, 9th Ed., page 4036, right hand column). Wax-soluble polymers, in the sense of the invention distinguish themselves in that the can be melted below approximately 100° C. and in that they show stickiness in the melted state. Suitable polymers are, for example, ethylene-vinylacetate-copolymers, polyamides, ethylene-alkylacrylate-copolymers, ethylene-acryl-acid-copolymers, polyvinylether and polyisobutes, as well as ionomer resins. Particularly preferred among these are ethylene-acrylacid-copolymers and ethylene-vinylacetate-copolymers (EVA).

The term "wax-soluble" polymers also includes those which already present a certain stickiness at room temperature, such as, for example, certain polyisobutenes with oily, viscous to caoutchouc-like consistency. Such products are sold under the commercial name Oppanol ((BASF, Germany), compare Römpp Chemical Lexicon, 9th Ed, V.4, pp. 3121–3122. Among these wax-soluble polymers that are sticky at room temperature are also raw materials based on polyvinylethyl-, methyl- and -isobutylether, which are sold under the commercial tradename of Lutonal (BASF, Germany), compare Römpp Chemical Lexicon, 9th Ed., V.3, p. 2566.

A specific property of the present invention is the incorporation of the discussed wax-soluble polymers, both in layer A) as well as in layer B). The wax-soluble polymers can be used singly or as a mixture. Identical or different wax-soluble polymers can be used in layer A) and in layer B). Layer A) preferably contains the wax-soluble polymer in a quantity of 10% to 60% by weight, specifically approximately 20% to 40% by weight. Layer B) contains the wax-soluble polymer in a quantity of 2% to 20% by weight, specifically approximately 5% to 10% by weight. As is apparent, the percentage of the wax-soluble polymer is preferably higher in layer A), i.e., the separation layer, than in layer B). The reasons for this is that layer B) has a greater adhesion to layer A), and thus better resolution is attained.

The wax-soluble polymer in layer B) requires that within the scope of the invention particularly preferably employed hard waxes, specifically in the form of ester waxes, are plasticized and thus the brittleness or "splinteriness" is eliminated from the thermo-transfer color. Ester waxes are very hard or brittle waxes. In other words, they can be pulverized in cold condition. If they are mixed, however, with the named wax-soluble polymers, then elastic to highly elastic products are generated which can no longer be pulverized.

Incorporation of the wax-soluble polymer into both layer A) as well as layer B) results in the functional interaction of both layers during the printing process. On the one side, the "release" capability of layer A) can be controlled, and on the other side, layer B) satisfies the function of a "matte" layer. Within the scope of the invention the matte layer plays a special role. During the printing process truly matte print-outs are produced. The basis for this is that during the printing process not just the thermo-transfer color becomes liquid and thus adheres to the substrate, specifically in the form of a paper acceptor, but also that the separation layer also softens and retains significant adhesion vis-a-vis the color layer, so that complete two-dimension transfer of, for example, printing symbols onto the paper acceptor, is not possible. Instead, the surface of the printed symbol is somewhat roughened up, so that the surface of the transferred symbol appears matte, due to light refraction/light diffusion.

The "deglossing" effect is further favored if layer B) contains a black pigment and the separation layer contains additional carbon black, specifically in a volume of approximately 20% to 50% by weight, which results in the used thermo-transfer ribbon providing adequate data privacy protection. With this beneficial design of the present invention silicic acid is preferably also incorporated into the separation layer. As a result, during production of the layer, the carbon black remains finely distributed within the layer and does not settle.

The thickness of layers A) and B) is not critical. Layer A) preferably has a thickness of approximately 0.2 μm to 5 μm, specifically of approximately 1 μm to 3 μm. Layer B preferably has a thickness of approximately 1.0 μm to 10 μm, specifically of approximately 3 μm to 6 μm. With respect to layer A), a resin-based layer is involved, whereby the resin-binding agent is preferably a solid resin with a softening range of approximately 70° C. to 200° C. The resin is preferably an alkyd-, epoxide, melamine-, phenol-, urethane-, and/or polyester- or co-polyester resin.

The carrier of the color ribbon according to the invention is not critical. Polyethyleneterephthalate foils (PETP) or capacitor papers are preferably employed as basic foil for the thermo-transfer ribbons. Selective parameters are: highest possible stress/strain values and thermal stability with small foil thickness. The PETP foils are obtainable in thickness as small as approximately 2.5 μm, capacitor paper in thickness as small as approximately 6 μm. During the printing process, the thermo-printhead attains temperatures of up to 400° C.; in other words, temperatures which lie above the softening point of PETP. In it suggested with the use of PETP foils that a particularly heat-resistant layer be provided on the reverse side of the foil which comes in contact with the thermo-head.

A further development of the concept according to the invention, specifically for attaining a beneficially sharp imprint, is based on inclusion of the teaching of European Patent EP-B-0 133 638. In accordance therewith, on the reverse side of the carrier layer a wax or wax-like material is formed, specifically with a thickness of not more than approximately 1 μm, and particularly preferred in the form of a molecularly developed layer, having a thickness of approximately 0.01 μm. In this case, the coating material preferably consists of paraffin, silicone, natural waxes, specifically carnauba wax, bees wax, Ozokerit and paraffin wax, synthetic waxes and polyethylene waxes, glycoles or polyglycoles, antistatic materials and/or surfactants. If such coating is provided on the reverse side heat transfer from the thermo-printhead to the thermo-transfer ribbon is smooth, with the result that particularly sharp prints are obtained.

The thermo-transfer ribbon according to the invention can be produced by various methods, using customary coating processes. This can be done, for example, by spraying or printing of a solution or dispersion, either by means of water or an organic solvent as dispersion agent or solvent, by application from the melt, which applies specifically with respect to the wax-based thermo-transfer color, or by means of normal coating with a wiper in the form of a watery suspension having finely distributed therein the-coating material. With respect to environmental considerations, the following procedure has proven itself particularly beneficial. First, a thin layer of a watery suspension of the starting materials of the separation layer is laid on the carrier, which, with evaporation of the water, causes the manufacture of layer A). After the development of layer A), follows the coating of a watery suspension of the starting material of the wax-based thermo-transfer color, whereby in customary fashion the water is evaporated after application of said material. The formed, dual-layered coating satisfies all specifications within the scope of the assigned task. The thermo-transfer color can, however, also be applied, for instance with a wiper, to the separation layer in the form of a melt, according to the usual coating technologies. The temperature of the respective melt should, generally, be approximately 100° C. to 130° C. Following the coating, the applied materials are merely cooled down.

With respect to the practical or particularly beneficial realization of the present invention, the following parameter conditions can be stated regarding application quantities of the individual layers or their thicknesses:

Thermo-transfer color layer B), approximately 1 $g/m^2$ to 10 $g/m^2$, preferably approximately 3 $g/m^2$ to 6 $g/m^2$;

Separation layer, 0.2 $g/m^2$ to 5 $g/m^2$, preferably approximately 0.5 $g/m^2$ to 1.5 $g/m^2$;

Carrier foil, specifically polyester film, having a thickness of approximately 2 $\mu$m to 8 $\mu$m, preferably a thickness of approximately 4 $\mu$m to 5 $\mu$m, and the addressed reverse side coating in a thickness of approximately 0.01 $g/m^2$ to 0.2 $g/m^2$, preferably approximately 0.05 $g/m^2$ to 0.1 $g/m^2$.

The addressed low cohesion of the thermo-transfer color, giving consideration to the other discussed characteristics, specifically with respect to the preferred refinement in the form of "closely cut" waxes, leads to a mechanical anchoring of the thermo-transfer colors on the printed substrate, specifically the paper. By simultaneous incorporation of the wax-soluble polymers in the thermo-transfer color and the separation layer, there is provided the possibility of controlling the "release" capability of the separation layer. This guarantees excellent edge sharpness, resolution and high optical density, including the desirable matte and non-glossy printout. It comes as surprise that, even without a "topcoat", any kind of paper, i.e., smooth as well as rough, can be used, achieving excellent print quality. It is particularly advantageous to employ the thermo-carbon ribbons according to the invention in fax machines with relatively good resolution, for example Xerofax, etc. The thermo-transfer ribbons can also be used with particular advantage in application fields for office printers, postage machines and label printing devices.

In the following, the invention is explained in more detail, using

EXAMPLES.

Example 1

On a customary carrier made of polyester, having a thickness of approximately 6 $\mu$m, a material consisting of the following components was applied by wiper in order to form the separation layer:

| Component | Percentage composition |
|---|---|
| polyester resin | 40 parts by weight |
| wax-soluble polymer (EVA) | 30 parts by weight |
| carbon black | 29 parts by weight |
| silicic acid | 1 part by weight |
| | 100 parts by weight |

The above material was applied in a solution-dispersion (approximately 15% in toluol/isopropanol 80:20) in dry concentration of approximately 1.0 $\mu$m. Evaporation of the solvent was done by passing hot air over it at a temperature of approximately 100° C. Subsequently, the thermo-transfer color was applied in the form of a melt, at a temperature of approximately 105° C., by means of flexo-print, using the following formulation.

| Component | Percentage composition |
|---|---|
| Micro-crystalline wax | 50 parts by weight |
| Ester wax | 25 parts by weight |
| Wax-soluble polymer (EVA) | 10 parts by weight |
| Carbon black | 15 parts by weight |
| | 100 parts by weight |

Example 2

The processing set forth above in Example 1 was repeated with the modification that the following formulations were used for the separation layer and the color layer.

| Component | Percentage composition |
|---|---|
| Separation Layer | |
| Polyurethane resin | 15 parts by weight |
| Polyester resin | 25 parts by weight |
| Wax-soluble polymer (EVA) | 30 parts by weight |
| Carbon black | 28 parts by weight |
| Silicic acid | 2 parts by weight |
| | 100 parts by weight |
| Transfer Color Layer | |
| Paraffin wax | 60 parts by weight |
| Ester wax (carnauba wax) | 17 parts by weight |
| Wax-soluble polymer (EVA) | 8 parts by weight |
| Tinting carbon black | 15 parts by weight |
| | 100 parts by weight |

The foregoing disclosure is provided as a means of enabling the skilled artisan to practice this invention. While examples have been included throughout, the breadth and scope of the invention shall not be limited thereby, but rather is to be determined by the appended claims, including any and all equivalents materials and permutations thereof.

Having thus described the invention, we claim:

1. A thermo-transfer ribbon comprising a carrier material having deposited on one side of said carrier a wax layer B) of a thermo-transfer color and having an additional layer A) arranged between said carrier and said wax layer, said ribbon being characterized in that said additional layer is a resin separation layer A) for said wax layer B) wax, that the wax of said wax layer have a melting point of approximately 70° C. to 110° C., and that in both said layers A) and B) a wax-soluble polymer is finely dispersed.

2. The thermo-transfer ribbon according to claim 1, characterized in that the melting point of the wax component of the wax layer lies between approximately 75° C. and 90° C.

3. The thermo-transfer ribbon according to claim 1, characterized in that layer A) contains approximately 10% to 60% by weight of wax-soluble polymers.

4. The thermo-transfer ribbon according to claim 3, characterized in that layer A) contains approximately 20% to 40% by weight of wax-soluble polymers.

5. The thermo-transfer ribbon according to claim 1, characterized in that layer B) contains approximately 2% to 20% by weight of wax-soluble polymers.

6. The thermo-transfer ribbon according to claim 5, characterized in that layer B) contains approximately 5% to 10% by weight of wax-soluble polymers.

7. The thermo-transfer ribbon according to claim 1, characterized in that the wax layer B) has a viscosity of approximately 50 mPa.s to 250 mPa.s measured in a rotation viscosimeter at 100° C.

8. The thermo-transfer ribbon according to claim 7, characterized in that the wax layer B) has a viscosity of approximately 70 mPa.s to 120 mPa.s measured in a rotation viscosimeter at 100° C.

9. The thermo-transfer ribbon according to claim 1, characterized in that the wax of layer B) is a wax selected from the group consisting of natural waxes, carnauba wax, candililla wax, micro-crystalline wax, ester waxes, paraffin waxes synthetic waxes, polyethylene wax, and mixtures thereof.

10. The thermo-transfer ribbon according to claim 1, characterized in that the wax-soluble polymer is selected from a group consisting of an ethylene-vinylacetate-copolymer, an ethylene-acryl-acid-copolymer, a polyamine and an ionomer resin.

11. The thermo-transfer ribbon according to claim 1, characterized in that the resin layer A) is a solid resin have a softening range of 70° C. to 200° C.

12. The thermo-transfer ribbon according to claim 11, characterized in that the resin component of the resin layer is selected from the group consisting of alkyd-, epoxide-, melamine-, phenol-, urethane- and polyester resin.

13. The thermo-transfer ribbon according to claim 1, characterized in that layer B) contains a black pigment and layer A) contains, in addition, conductive carbon black and silicic acid.

14. The thermo-transfer ribbon according to claim 1, characterized in that layer A) has a thickness of approximately 0.2 μm to 5 μm.

15. The thermo-transfer ribbon according to claim 14, characterized in that layer A) has a thickness of approximately 1 μm to 3 μm.

16. The thermo-transfer ribbon according to claim 1, characterized in that layer B) has a thickness of approximately 1 μm to 10 μm.

17. The thermo-transfer ribbon according to claim 16, characterized in that layer A) has a thickness of approximately 3 μm to 6 μm.

18. The thermo-transfer ribbon according to claim 1, wherein the color component of the wax layer comprises a coloring pigment, in a quantity of 5% to 20% by weight.

19. A thermo-transfer ribbon consisting essentially of a ribbon having deposited on one side a color layer comprised of a coloring agent, a wax having a melting point of approximately 70° C. to 110° C., and a finely dispersed wax-soluble polymer, and a release layer positioned between said color layer and said ribbon, said release layer comprised of a resin and a finely dispersed wax-soluble polymer.

20. A thermo-transfer ribbon comprised of a carrier having deposited thereon a release layer, said release layer comprised of a resin, 10 to 60 percent by weight of a finely dispersed wax soluble polymer and optionally a colorant, and a color transfer layer deposited on said release layer, said color transfer layer comprised of wax, a colorant, and at least 2 to 20 percent by weight of a finely dispersed wax-soluble polymer.

* * * * *